United States Patent [19]

Brunson

[11] 3,962,699

[45] June 8, 1976

[54] SWITCH CLOSURE RESPONSIVE LOGIC SIGNAL GENERATION MEANS

[76] Inventor: Raymond D. Brunson, 5404 Brixham Court, Burke, Va. 22015

[22] Filed: July 15, 1974

[21] Appl. No.: 488,282

[52] U.S. Cl. ..... 340/323 B; 235/92 GA; 273/54 E; 307/247 A; 340/365 E

[51] Int. Cl.[2] ..... A63D 5/04

[58] Field of Search ..... 340/323, 323 B, 365 E; 273/54 C, 54 E; 235/92 GA; 200/61.1, 61.11, DIG. 23; 307/247 A

[56] References Cited

UNITED STATES PATENTS

| | | | |
|---|---|---|---|
| 3,585,374 | 6/1971 | Pollard | 235/92 GA |
| 3,705,722 | 12/1972 | Bolger et al. | 273/54 C |
| 3,725,680 | 4/1973 | Silva | 307/268 |
| 3,755,691 | 8/1973 | Cassarino | 307/208 |

*Primary Examiner*—John W. Caldwell
*Assistant Examiner*—James J. Groody
*Attorney, Agent, or Firm*—Warren H. Kintzinger

[57] ABSTRACT

A command signal circuit accepting switch input information from a plurality of mechanical switches introducing undesired contact bounce, and providing a single clean output command signal. The circuit accomodates the plurality of input switches with circuit sections in parallel and "OR"ing to the output resolving all switch commands to one signal. Filtering is applied at a logic receiving end of lead lines to take out noise ripple induced with long leads, and the filter output is applied to both a one-shot multivibrator and a delay circuit having outputs "OR"ed together with the one-shot taking out the contact bounce on the leading edge with switch closure and the delay circuit taking care of contact bounce on the trailing portion of the switching action with switch opening.

5 Claims, 9 Drawing Figures

SWITCH CLOSURE RESPONSIVE LOGIC SIGNAL GENERATION MEANS

Figure 1:
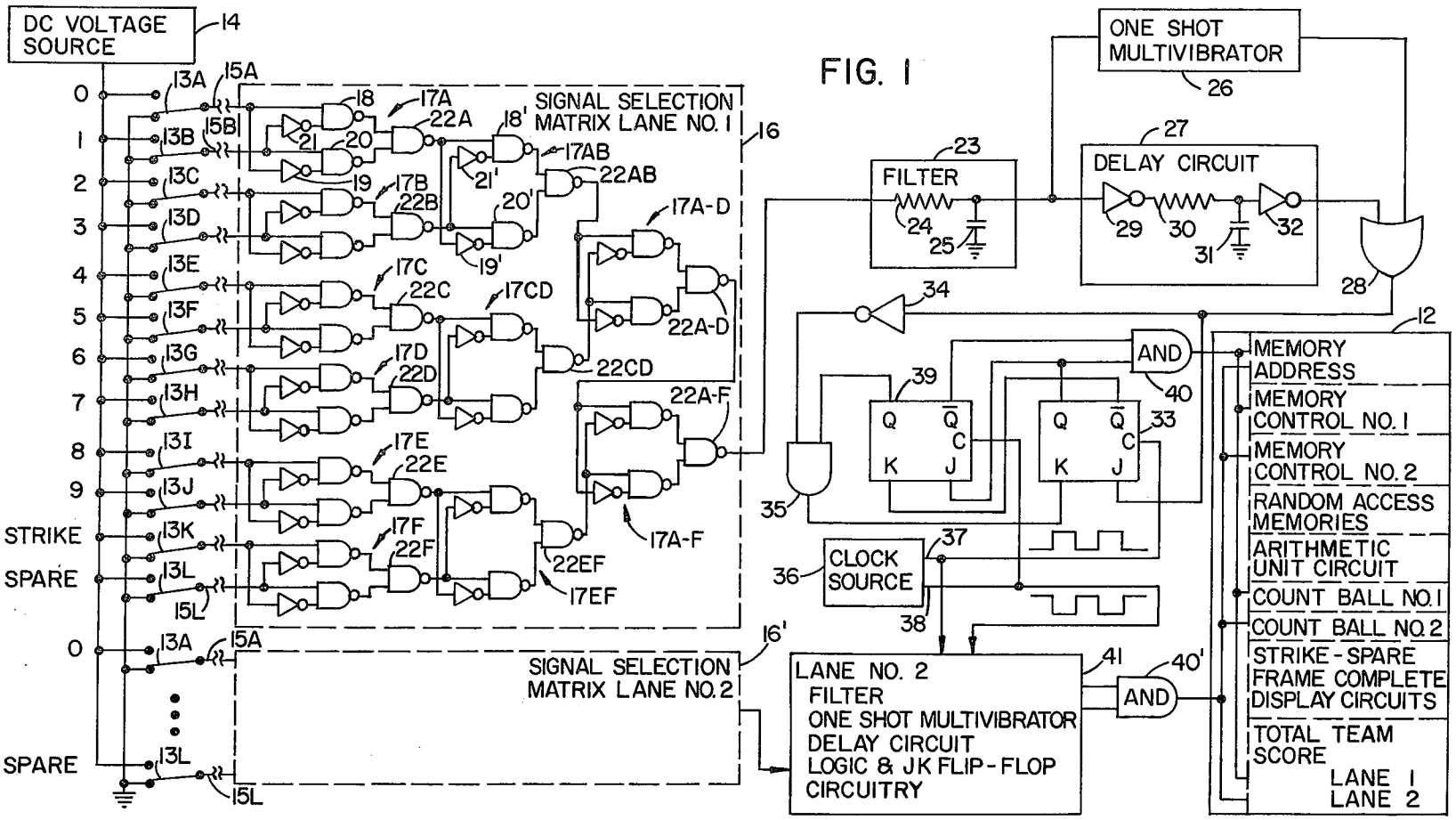

This invention relates in general to signal conditioner circuits and, in particular, to a signal conditioner circuit producing clean output command signals from mechanical input switches that introduce undesired contact bounce.

In bowling scoring control there is a requirement for production of output command signals (one at a time) with switch closure of a mechanical switch representing an input of information. It is important that the output command signal be free of switch contact bounce, free of noise induced with long leads, that the output command signal conditioner circuit be low in cost, and produce only one command signal per switch closure. Substantially every mechanical switch known heretofore has significant contact bounce on both switch closure and switch opening, at least in terms of high speed response times attained with solid state logic gated circuitry (response times in the order of 25 nanoseconds and shorter). Such contact bounce manifests itself as noise, or a signal varying between zero and maximum applied voltage amplitudes, that without correction or blocking appears as erroneous signals of logic 0 and logic 1 presenting command signals in error. Further, with the physical layout of alleys constructed for the game of bowling, scoring control input switches with some systems are located at the bowlers approach end of the alley lanes, and the display units where the circuit logic is located are above the alley bed, at the pin ends of the alley lanes, and switching signal lead lines are generally over fifty feet in length. Thus, induced noise pick up on such long logic circuit switching control signal input lines further compounds the switch bounce erroneous output command signal problem and the noise factor must be attenuated in insuring output command signal reliability. It is important also that the system be a cleanly reliable system with low maintenance requirements, since low cost is mandatory in the highly competitive bowling scorekeeper market. Further, when a switch is activated to give a signal input (for example, a strike), only one signal input should be given to the system.

It is, therefore, a principal object of this invention to provide a signal conditioner circuit producing clean output command signals responsive to switch input signals from relatively inexpensive mechanical switches having opening and closing contact bounce.

Another object is to provide a signal conditioner circuit producing single clean output command signals from a plurality of paralleled mechanical signal input switches.

A further object with such a signal conditioner circuit is signal electronic lockout when two side-by-side input switches are actuated.

Still another object with such a signal conditioner circuit is to remove induced noise picked up on long lead signal input switch-to-logic circuit signal lines.

Features of this invention useful in accomplishing the above objects include, in a signal conditioner circuit, a plurality of mechanical switches, having contact bounce, connected through long leads to electrical interlock circuitry providing signal lockout when two, side-by-side, input switches are actuated. All switch commands for one bowling lane are resolved to one signal that is filtered before being applied to logic level responsive receiving circuitry for induced noise ripple take-out with the filter output applied to and through a one-shot multivibrator and a delay circuit with the outputs "OR"ed together. The one-shot takes out contact bounce on the leading edge with switch closure, and the delay circuit blocks out contact bounce on the trailing portion of the input signal switching action with switch opening. The signal conditioner circuit for one bowling lane is connected through two J-K flip-flops to output command utilizing circuitry in the same manner that the signal conditioner circuit for an adjoining bowling lane is connected through its two J-K flip-flops. A clock source producing a square wave output clock and an inverted square wave clock is so cross output connected to the two signal conditioner circuits for adjoining lanes that only one of them is clocked for an output at a time.

A specific embodiment representing what is presently regarded as the best mode of carrying out the invention is illustrated in the accompanying drawings.

In the drawings

Figure 2A:
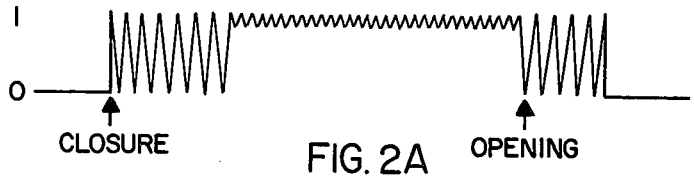
Figure 2B:
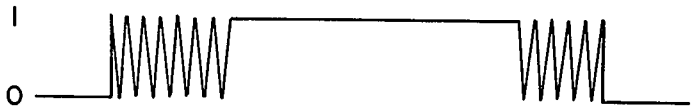
Figure 2C:
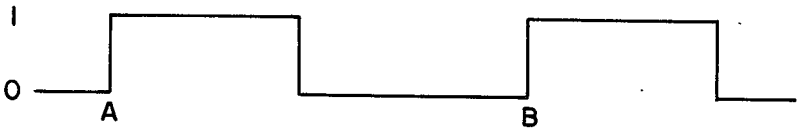
Figure 2D:
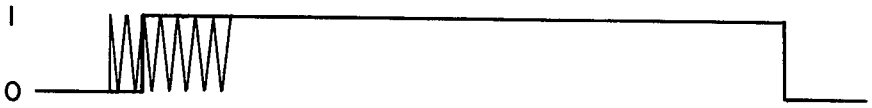
Figure 2E:
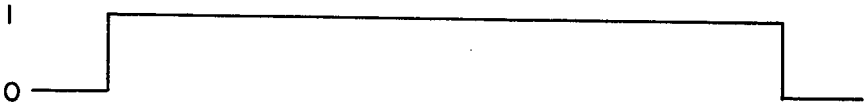
Figure 2F:
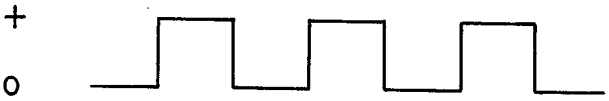
Figure 2G:
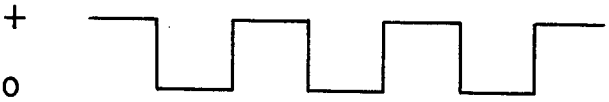
Figure 2H:
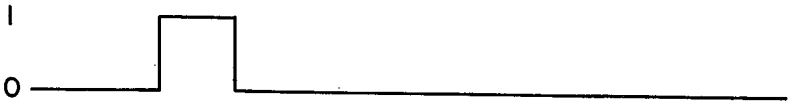

FIG. 1 represents a block schematic of dual signal conditioner circuits for side-by-side bowling lanes clock interconnected together, for single exclusive clock time activation of output utilizing circuitry and display equipment;

FIG. 2A, a switch activated mechanical switch output signal waveform with switch closure bounce and opening bounce and induced noise ripple picked up in a long signal lead before filtering;

FIG. 2B, the same resulting switch signal after iduced noise ripple filtering;

FIG. 2C, the resulting waveform output of a one-shot multivibrator receiving the FIG. 2B waveform as a switch signal input;

FIG. 2D, the resulting waveform output of a delay circuit receiving the FIG. 2B waveform as a switch signal input;

FIG. 2E, the output of an "OR" gate receiving the switch signal processed waveforms of FIGS. 2C and 2D as inputs;

FIGS. 2F and 2G, a clock square wave signal and the clock inverse signal from a common clock source; and, FIG. 2H, the resulting clean command signal without switch bounce passed one time with clock activation strobing of a two J-K flip-flop output circuit as a command signal to utilizing circuitry.

Referring to the drawings

The signal conditioner circuit system of FIG. 1 for side-by-side bowling lanes is shown to have two substantially identical signal conditioner circuits, with one shown in considerable schematic detail and the other primarily in simplified block diagram form, both connected for feeding command signals to utilizing circuitry 12. Each of the signal conditioner circuits is equipped with a plurality of two-pole single throw mechanical switches 13A through 13L, corresponding to bowling scores 0 through 9, strike and spare, respectively. Please note that the circuitry shown, described, and claimed in this case is directed to command signaling conditioning and not with the intelligence to be conveyed from respective switches to utilizing circuitry and devices and the intelligence conveying linkage circuitry is not shown. The mechanical switches 13A – 13L are, in the bowling environment of this instance, manually operated switches afflicted with undesired contact bounce both on closure and on opening that, with solid state logic gated circuitry having response times in the order of 25 nanoseconds and less, results in erroneous signals of logic 0 and logic 1, and thereby output command signals in error if not protected against. The switches 13A – 13L, as shown, have their contact throw arms against "off" contacts connected to ground, and their normally open contacts connected to DC voltage source 14. The contact throw arms of switches 13A – 13L are connected through long lead lines 15A through 15L, respectively, to signal selection matrix circuits 16 and 16' for bowling lanes 1 and 2, respectively.

Each of the matrix circuits 16 and 16' have, as shown for circuit 16, a plurality of six signal selection sub-circuits 17A, 17B, 17C, 17D, 17E, and 17F, connected to respective pairs of the switches 13A – 13L. The line 15A from switch 13A is connected as an input directly to NAND gate 18 and through inverter 19 to NAND gate 20 while line 15B is connected as an input directly to NAND gate 20 and through inverter 21 to NAND gate 18, and the outputs of NAND gates 18 and 20 are connected as inputs to NAND gate 22A. Thus, sub-circuit 17A is a two-input switching resolving circuit with the logic equation $Y=S_1\overline{S_2}+\overline{S_1}S_2$(i.e., switch 1 and not switch 2, or not switch 1, but switch 2) in a sub-circuit resolving both input switch commands to one signal to reduce logic elements and cost, and to guard against multiple switch signals at the same time. Sub-circuit 17B, connected to switches 13C and 13D, in the same manner as sub-circuit 17A is connected to its inputs, and the output NAND gates 22A and 22B are connected as inputs to second level signal selection sub-circuit 17AB, similar to sub-circuits 17A – 17F, with the output of NAND gate 22A connected as an input directly to NAND gate 18' and through inverter 19' to NAND gate 20', while the output of NAND gate 22B is connected as an input directly to NAND gate 20' and through inverter 21' to NAND gate 18', and the outputs of NAND gates 18' and 20' are connected as inputs to NAND gate 22AB. Second level sub-circuits 17CD and 17EF are the same as sub-circuit 17AB, and the outputs of NAND gates 22AB and 22CD are connected as inputs to a higher tier sub-circuit 17A-D, similar in gating structure and function to the other sub-circuits 17 at any level, and the output of NAND gate 22A-D thereof, along with the output of NAND gate 22EF of sub-circuit 17EF, are connected as inputs to the final level sub-circuit 17A-F. Thus, at the final output from NAND gate 22A-F, and from the signal selection matrix 16, anytime any two of the input switches 13A through 13L are manually activated to the DC voltage source 14 voltage, the output is inhibited. However, whenever an odd number of input switches more than two are activated, an output would appear, but this is an odd circumstance unlikely to occur with any significant frequency. Further, even when two switches are actuated, usually one is actuated sufficiently in advance of the other that an output appearing out of NAND gate 22A-F will actuate the following logic circuitry.

With normal single switch actuation, a single waveform, such as shown in FIG. 2A, with switch closure bounce and opening bounce, and induced noise ripple picked up in a long signal lead, appearing at the output of NAND gate 22A-F, is applied through filter 23 having a signal series resistor 24 and then a connection through capacitor 25, to ground. The resulting filtered switching signal waveform, such as shown in FIG. 2B, is applied as a signal input to both one-shot multivibrator

26 and to delay circuit 27. The output waveform, such as shown in FIG. 2C of the one-shot multivibrator 26 is applied as one input to "OR" gate 28, and the waveform is with the one-shot tripping to logic 1 voltage at point A in time for a first tripping actuation at the first positive bounce on a switch closure, with this held for a constant predetermined time (normally shorter than the switch closure time) as fixed by components in the multivibrator circuit, regardless of what happens to the input waveform. It then returns to the original 0 logic quiescent condition. Then when the switch is opened at point B in time with the first positive going bounce with switch opening in the waveforms of FIGS. 2A and 2B, the one-shot multivibrator is again tripped on to logic 1 voltage for the constant predetermined time interval.

The delay circuit 27, with, serially, inverter 29, series resistor 30, a connection through capacitor 31, to ground, and inverter 32, gives an output square wave response, such as shown in FIG. 2D, to the switching signal input waveform of FIG. 2B. The trigger on of this waveform is with triggering voltage build up with switch bounce at mechanical switch closure (superimposed on FIG. 2D). This output is applied as the additional input, along with the one-shot multivibrator output as a input, to the OR gate 28 to result in the FIG. 2E waveform output, with, thereby, the one shot taking care of contact bounce on the switch closure leading edge, and the delay circuit taking care of contact bounce on the switch opening signal trailing edge. This is with the OR gate output signal trailing edge determined by how long the switch is held closed, plus the delay of delay circuit 27.

The output waveform of FIG. 2E from OR gate 28 is applied as a signal input to the J terminal of J-K flip-flop 33, and through inverter 34 to AND gate 35. Clock source 36 provides a 0 to + square wave output clock waveform and a 0 to + inverse clock waveform at output terminals 37 and 38, respectively, connected to the C clock terminals of J-K flip-flop 33 and J-K flip-flop 39. Thus, with the logic 1 output of OR gate 28 applied to the J input of 33 and when the clock input to J-K flip-flop 33 is positive, the Q output thereof that is connected as an input to AND gate 40 and to the J input of J-K flip-flop 39, goes positive. Since the $\overline{Q}$ output of J-K flip-flop 39, that is connected as the other input to AND gate 40, is already positive, the inputs of AND gate 40 are then "AND"ed together with the output going positive. However, with the positive Q output of J-K flip-flop 33 also applied to the J input of J-K flip-flop 39 when the next positive pulse of the inverse clock waveform from clock terminal 38 is applied to the C clock terminal of J-K flip-flop 39, $\overline{Q}$ thereof immediately goes negative to cut off the output of AND gate 40 to zero and give a resulting waveform such as shown in FIG. 2H as timing controlled by the clock waveforms of FIGS. 2F and 2G. Simultaneously with the Q output of J-K flip-flop 39 then going positive and gate 35 inhibited from providing a positive output to the reset K terminal of J-K flip-flop 33 until the OR gate waveform of FIG. 2E again returns to zero and reset is accomplished for both J-K flip-flops 33 and 39. The logic circuitry in circuit section 41 for lane number 2 is substantially the same as with that for lane number 1 other than that the clock signal terminals are connected to J-K flip-flops in reverse to the connections to J-K flip-flops 33 and 39 of the lane number 1 circuitry so that there will never be simultaneous command signals out of AND gates 40 and 40' to the utilizing circuity 12.

It has been pointed out that the signal conditioner circuit is subject to signal electronic lockout when two side-by-side switches are activated, but this also extends to when any two of the 12 switches of a bowling lane are actuated. While normal operation is with only one switch for a bowling lane being actuated at a time, it is possible that simultaneous actuation of odd numbers of switches 3, 5, etc., could result in a through signal and a command output, but this is a very unlikely, accidental occurrence.

Whereas this invention is herein illustrated and described with respect to a single embodiment hereof, it should be realized that various changes may be made without departing from essential contributions to the art made by the teachings hereof.

I claim:

1. In a signal conditioner circuit for developing reliable command output signals from mechanical switch input signals having contact bounce both on closure to voltage potential and on opening: mechanical switch signal input means; one shot multivibrator means; logic level actuation delay circuit means; circuit means interconnecting said mechanical switch signal input means as a signal source to the input of said one shot multivibrator means and to the input of said logic level actuation delay circuit means; OR gate means connected for receiving the output of said one shot multivibrator means and the output of said logic level actuation delay circuit means, the output of said OR gate circuit means comprising a pulse, the leading edge of which coincides with the time occurrence of the first contact during contact bounce on switch closure as defined by the time of said one shot multivibrator means, with said OR gate means output pulse being maintained through off intervals of said one shot multivibrator means while the switch signal input means remains on, by time overlapping activation of said logic level actuation delay circuit means; said mechanical switch signal input means comprising a plurality of mechanical switches, each of said switches connected for actuation from contact closure connection to a voltage potential reference source to contact closure actuation connection to a DC source; said circuit means comprising logic circuitry responsive to the voltage levels respectively defined by said reference and DC voltage sources; said logic circuitry comprising a first plurality of six logic circuits defining a first level of logic circuitry, each of said first plurality of circuits connected to and responsive to closure of an associated pair of a plurality of 12 of said mechanical switches, to develope an output level defined by said DC voltage source in response to a single one of said associated pair of mechanical switches being closed to connection with said DC voltage source; a second plurality of three like logic circuits defining a second level of logic circuitry, each of said second plurality of circuits connected to the outputs of an associated respective pair of said first plurality of logic circuits, a further logic circuit, defining a third level of logic circuitry, connected to the outputs of first and second ones of said second plurality of logic circuits; a second further like logic circuit connected respectively to the output of the third one of said second plurality of logic circuits and the output of said further logic circuit, with the output of said second further logic circuit comprising the output of said logic circuitry and being applied to said filter circuit means.

2. The signal conditioner circuit of claim 1, wherein said circuit means interconnecting said mechanical switch signal input means as a signal source further comprises long signal lead lines, such as would lead from said switch input means at one end of a bowling alley lane to said logic circuitry at the other end of a bowling alley lane, and said circuit means further comprising filter circuit means through which the output of said logic circuitry is applied as said input to said one shot multivibrator means and said input to said logic level actuation delay circuit means.

3. The signal conditioner circuit of claim 2, wherein said mechanical switch signal input means comprises twelve manually actuated switches at a bowling alley control panel, with said 12 switches respectively and individually representing 0 through 9, strike, and spare.

4. The signal conditioner circuit of claim 1, further comprising a source of clock and clock complement pulses, each defined by first and second logic levels corresponding to said reference and DC voltage source levels, clock-controlled signal output strobing logic means receiving the output of said OR gate means and said clock and clock complement pulses as respective inputs thereto and developing a single clock pulse coincident output pulse corresponding in time to the next DC voltage level clock pulse following each transition of the output from said OR gate means from said reference voltage to said DC voltage level, said clock-controlled signal output strobing logic means comprising means for developing clock complement pulses; first and second J-K flip-flops, each having J and K inputs, Q and $\overline{Q}$ outputs, and a clock input; said clock pulses and clock complement pulses being applied individually to the respective clock inputs of said J-K flip-flops; a first AND gate means; signal inverting means receiving the output of said OR gate means; said first AND gate means receiving the output of said signal inverting means and the Q output of said second J-K flip-flop, as respective inputs thereto; the output of said first AND gate means applied to the K input of said first J-K flip-flop, the output of said OR gate means being further applied to the J input of said J-K flip-flop; means interconnecting the Q output of said first J-K flip-flop and the K input of said second J-K flip-flop; a second AND gate means; means interconnecting the $\overline{Q}$ output of said first J-K flip-flop and the J input of said second J-K flip-flop; the Q output of said first J-K flip-flop, and the $\overline{Q}$ output of said second J-K flip-flop being applied as respective inputs to said second AND gate means; with the output of said second AND gate means comprising the said clock-coincident output signal.

5. The signal conditioner circuit of claim 4, wherein a second like conditioner circuit is operative from inputs from a further plurality of mechanical switches, with said clock and clock complement pulses being reversed as applied to the respective clock inputs of the first and second J-K flip-flops thereof, to develope a single clock synchronous output pulse from said second like conditioner circuit corresponding in time to the next DC voltage level clock complement pulse following each transition of the output of the OR gating means associated with said second conditioner circuit from said reference voltage to said DC voltage level.

* * * * *